United States Patent [19]

Kröner

[11] Patent Number: 4,805,161

[45] Date of Patent: Feb. 14, 1989

[54] DRIVE ARRANGEMENT FOR AN ELECTRONICALLY CONTROLLED WATCH

[75] Inventor: Wolfgang Kröner, Pforzheim, Fed. Rep. of Germany

[73] Assignee: Pforzheimer Uhrenwerke Porta GmbH, Pforzheim, Fed. Rep. of Germany

[21] Appl. No.: 142,668

[22] Filed: Jan. 11, 1988

Related U.S. Application Data

[63] Continuation of Ser. No. 878,345, Jun. 25, 1986.

[30] Foreign Application Priority Data

Jun. 25, 1985 [DE] Fed. Rep. of Germany ..... 3522688

[51] Int. Cl.[4] ..... G04B 19/02

[52] U.S. Cl. ..... 368/220; 368/324; 368/322; 368/323

[58] Field of Search ..... 368/220, 318, 157–159, 368/76, 80, 88, 160, 323

[56] References Cited

U.S. PATENT DOCUMENTS

| | | | |
|---|---|---|---|
| 4,090,352 | 5/1978 | Jeannet et al. | 368/220 |
| 4,249,251 | 2/1981 | Wuthrich | 368/220 |
| 4,351,040 | 9/1982 | Aoki | 368/220 |
| 4,365,889 | 12/1982 | Ushikoshi et al. | 368/220 |
| 4,378,957 | 4/1983 | Malkin et al. | 368/220 |
| 4,488,819 | 12/1984 | Schaffner | 368/220 |
| 4,496,246 | 1/1985 | Ota et al. | 368/220 |

*Primary Examiner*—Bernard Roskoski

[57] ABSTRACT

In a drive gear structure for an electronically controller watch which includes a stepping motor having a drive pinion in engagement with an intermediate gear disc and a center gear in engagement with an intermediate gear pinion associated with the intermediate gear disc, a reducing gear structure is provided which has a reducing gear disc which is also in engagement with the same center gear disc and a reducing gear pinion which is in engagement with the minute gear of the watch. The single center gear disc is somewhat larger in width than the corresponding second gear disc of a corresponding watch with second hand indicator but not as wide as a second gear disc and second gear pinion used for a corresponding watch with second hand. The intermediate gear pinion and the reducing gear disc which are both in engagement with the second gear disc have the same pitch.

3 Claims, 2 Drawing Sheets

DRIVE ARRANGEMENT FOR AN ELECTRONICALLY CONTROLLED WATCH

This application is a continuation application of application Ser. No. 878,345 of June 25, 1986, whose priority is claimed.

BACKGROUND OF THE INVENTION

The invention relates to a drive gear arrangement of an electronically controlled wristwatch whose operating mechanism includes a stepping motor having a rotor shaft provided with a drive structure which is coupled by way of an intermediate drive gear and center gear and reducing gear structures to the watch's minute hand gear.

The manufacture of such an operating mechanism requires a plurality of work operations which must be executed with great precision and which are therefore quite tedious and expensive. This is especially true for today's wristwatches which the customer wishes to be quite small and especially very slim. It is also to be taken into consideration that the various components of the operating mechanism must be manufactured with great precision and the whole gearing mechanism must be assembled with the same precision such that the gears and pinions of the operating mechanism are in precise engagement. The various shafts must be spaced from one another correctly and they need to be perfectly parallel and cooperating pairs of gears should be in engagement with one another over the full desired width of the gear structure. In the past with relatively large watches it was possible to provide relatively wide pinions to insure that the associated gear discs were in full gear width engagement but with today's slim watches also the pinions are to be made relatively narrow so that axial positioning of the various gears has become a matter of great importance.

Such considerations also apply with regard to the intermediate gear structure and the second gear disc and also with regard to the engagement of the second gear pinion and the disc of the reducing gear structure disposed between the second hand gear and the minute hand gear.

The invention concerns especially these two pairs of gears, that is, the engagement of the intermediate gear and the second or center gear structure and also of the second gear structure with the reducing gear because these gearing structures are determining factors as far as the thickness of a watch is concerned since the second gear needs to be located in the center of the gear arrangement if the watch is to be provided with a second hand. Then there is an overlapping of intermediate gear structure, second gear structure, reducing gear structure, minute gear structure and hour gear structure and the intermediate gear structure, the second gear structure and the reducing gear structure need to have relatively wide pinions in order to insure proper engagement of the appropriate gear discs without requiring overly accurate positioning and guiding of the gears.

The required transmission ratio provided between these gears depends on the rotational steps per second of the stepping motor, that is, on the number of pulses per second supplied to the stepping motor by the electronic control circuitry.

If the presence of a second hand is desired, then the transmission ratio between the second gear and the minute gear is 60:1. However, if the watch has no second hand, the transmission ratio between the second hand gear, that is then the center gear, and the minute gear may be selected on the basis of other considerations. Then it is of course also unimportant by which step length the center gear advances, it does not have to be by the second angle of 6° per second.

SUMMARY OF THE INVENTION

The present invention utilizes these considerations by combining the functions of the second gear disc and the second shaft drive pinion into a single gear which single gear is engaged by the intermediate gear structure and also the reducing gear. Although this measure will change the transmission ratio between the center shaft (normally second hand shaft) and the minute gear, this change can be easily accommodated by a change in the electronic control circuit which, depending on the change of the transmission ratio, may be corrected to provide a larger or smaller number of impulses in a given time. It is noted that, with the contemplated gear arrangement, the advance of the center shaft gear per impulse to the stepping motor is larger such that each single step of the stepping motor is equal a multiple, for example, twice the stepwise advance normally taken by the second hand. This however is of no import since the center shaft carries no second hand.

The arrangement according to the invention provides for a number of advantages. The center gear structure consists no longer of a gear disc and a relatively wide pinion, both mounted on the same shaft, but only of a single transmission gear which needs to be not wider than the second shaft pinion gear alone was made heretofore. This arrangement permits the slimming down of a watch to some degree. Another advantage of this arrangement is that the intermediate gear structure and the reducing gear structure are in engagement with the center gear in the same plane which permits further slimming down of the watch. The new arrangement also provides for an economical advantage as it saves the manufacture of one gear.

Also for economical reasons the pitch diameter of the drive gear is preferably selected to be the same as that of the normal second gear since this permits the use of the same intermediate gear structure. A change of the transmission ratio between the reducing gear structure and the minute gear is possible but it is preferred when only the pitch diameter of the gear disc of the intermediate gear structure is reduced, that is, adapted to the center shaft gear so that the reducing gear remains otherwise the same and mounted in an unchanged position.

Since the pinion of the intermediate gear structure and also the gear disc of the reducing gear structure are in engagement with the same drive gear and preferably in one and the same plane, it is sufficient that the drive gear is only slightly thicker than that of the second gear disc of the prior art structure. Preferably the thickness of the drive mechanism is the same as that of the pinion of the second gear structure of earlier arrangements, the larger thickness being obtained preferably by a widened gear rim of the center drive gear. Then the normally used second gear may be utilized, the widened gear rim being formed by a widening of the rim area. Preferably the gear rim is widened axially toward the second gear structure, that is, toward the front of the watch.

SHORT DESCRIPTION OF THE DRAWINGS

DESCRIPTION OF THE PREFERRED EMBODIMENT

Figure 1:
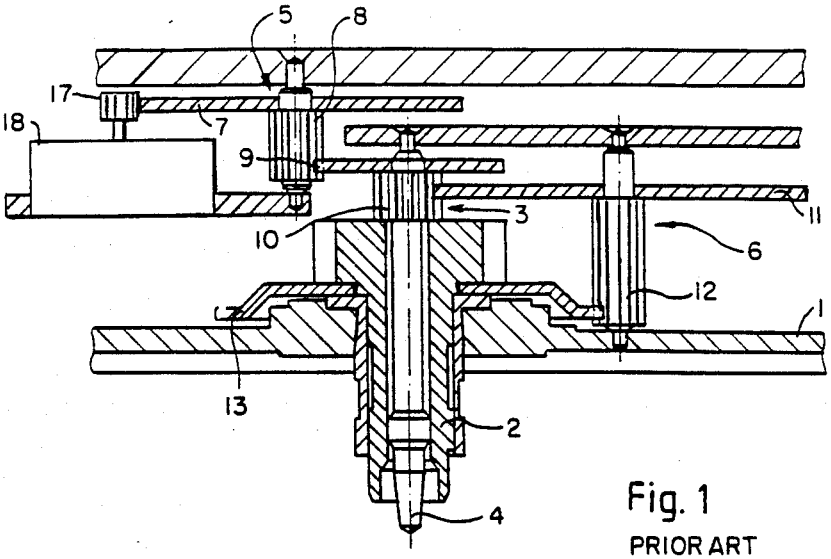
Fig. 1 PRIOR ART
FIG. 1 is a cross-sectional view of the prior art operating mechanism showing the arrangement around the hand shafts.
Figure 2:
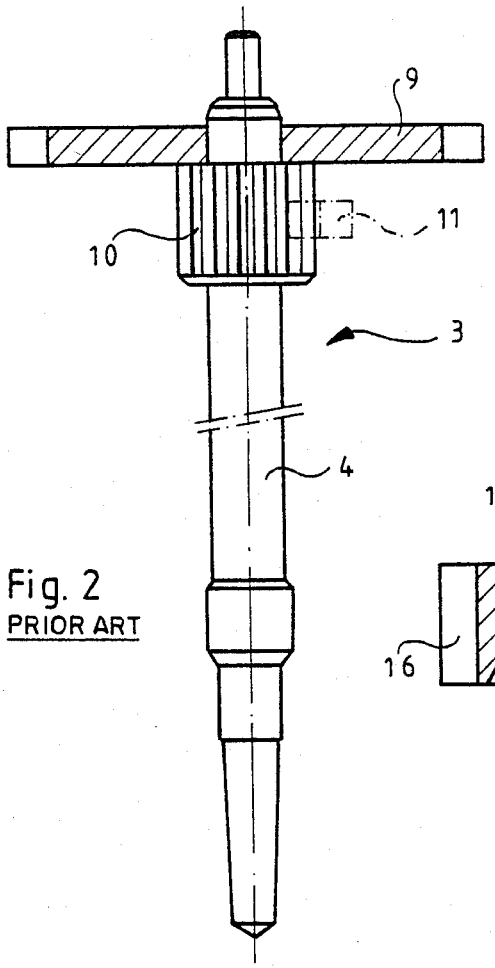
Fig. 2 PRIOR ART
FIG. 2 shows a second hand gear structure of prior design.

As shown in FIG. 1 the mounting plate 1 of a watch carries a minute gear 2 and centrally within the minute gear 2 a second gear structure 3 including a shaft 4. Also shown is the intermediate gear structure 5 and a reducing gear structure 6. The intermediate gear structure 5 comprises a gear disc 7 which is in engagement with the pinion 17 of a stepping motor 18 and an intermediate pinion 8. The second gear structure consists in accordance with FIG. 1 of the gear disc 9 which engages the pinion 8 of the intermediate gear structure 5 and the second gear pinion 10. The reducing gear structure 6 consists of the gear disc 11 which is in engagement with the second gear pinion 10 and of the reducing gear pinion 12. The reducing gear pinion 12 is in engagement with the gear disc 13 of the minute gear structure 2. The second gear structure as used heretofore is shown in greater detail in FIG. 2. As clearly shown therein the gear disc 9 and the pinion 10 are two separate parts of different diameters which are mounted on the shaft 4 usually by way of serrations.

Figure 3:
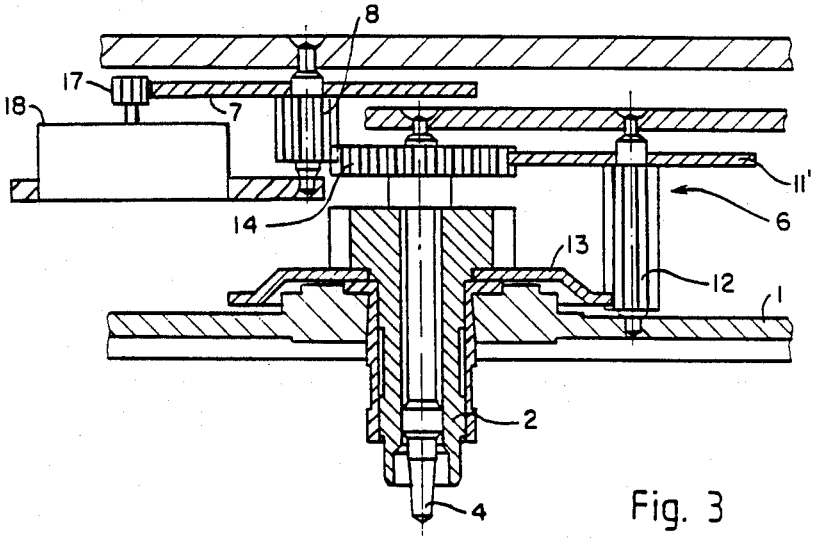
FIG. 3 shows a watch operating mechanism in accordance with the invention.
Figure 4:
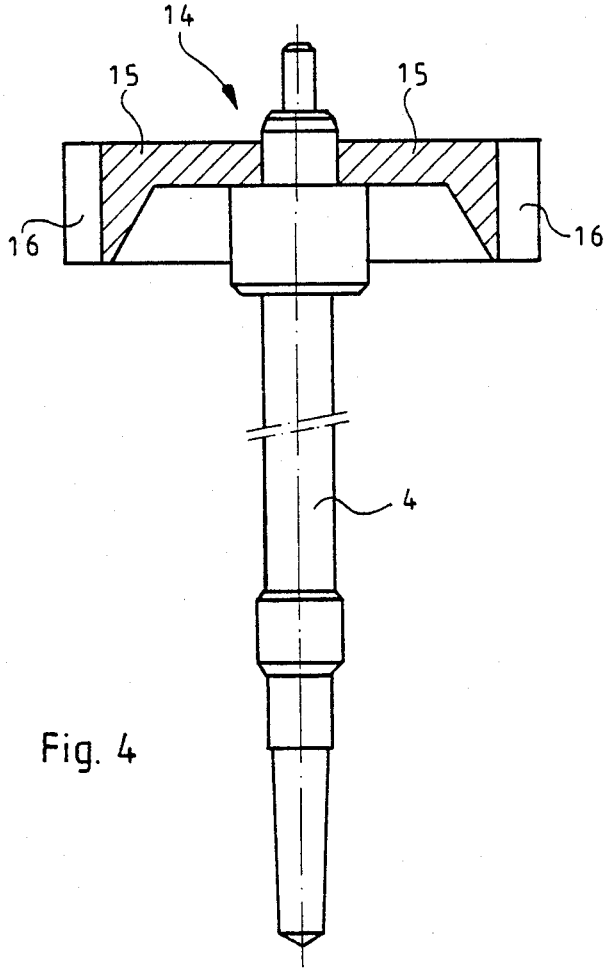
FIG. 4 shows a center drive gear structure in accordance with the arrangement of the invention.

The arrangement according to the invention as it is shown in FIGS. 3 and 4 is essentially the same as described above, that is, it includes all the same components with the exception of the center drive gear 14 and the gear disc 11' of the reducing gear structure 6 which is in engagement with the center drive gear. The center drive gear 14 is also mounted onto the shaft 4 possibly utilizing the same shaft 4 as in the prior arrangement. This is possible since as shown in FIG. 4 the gear disc portion 15 has the same thickness as the gear disc 9 of FIG. 2. The rim carrying the gear structure 16 however is substantially wider, about twice as wide as the gear disc portion 15, the rim projecting axially toward the center of the shaft 4, that is, the area previously taken up by the pinion 10 of the second gear structure 3.

As may be seen from FIG. 3 the pinion 8 of the intermediate gear structure and the gear disc 11' of the reducing gear structure 6 both are directly in engagement with the center gear 14 which has the same gear pitch as the intermediate gear pinion 8 and the reducing gear disc 11'. The gear disc 11' may be in engagement with the gear structure 16 of the gear disc 15 at any desired axial location so that the width of the watch operating mechanism and consequently the width of the watch can be easily changed by only small design changes, that is, by changing the area of engagement of the reducing gear disc 11 with the gear structure 16.

With the arrangement according to the invention the same basic components can be utilized in the manufacture of watches with and without second hand; however the watch without second hand can be manufactured at a lower price and can be made slimmer as it requires one less gear. The need for a different control circuitry does not add any cost.

What is claimed is:

1. A drive gear arrangement for an electronically controlled watch, especially a wristwatch, comprising a stepping motor having a drive pinion on its rotor shaft, an intermediate gear structure having a gear disc in engagement with said stepping motor pinion and an intermediate gear pinion, a central shaft carrying a center gear structure in engagement with said intermediate gear pinion and a reducing gear structure including a reducing gear disc in engagement with said center gear structure and being integral with a reducing gear pinion which is in engagement with a minute gear disc mounted on a hollow minute gear shaft concentrically receiving said central shaft, said center gear structure being a single gear and said intermediate gear pinion and said reducing gear disc having the same pitch and both said intermediate gear pinion and said reducing gear disc being in engagement with said single center gear.

2. A drive gear arrangement according to claim 1, wherein the thickness of the gear disc of the center gear is equal the thickness of the second gear disc and that the annular gear structure of said center gear is wider than the disc section thereof.

3. A drive gear arrangement according to claim 2, wherein said annular gear structure projects axially from said gear disc section toward the center of the shaft carrying the center gear.

* * * * *